United States Patent [19]

LaCroce

[11] 4,014,455

[45] Mar. 29, 1977

[54] ACCURATE FLOW CONTROL CONTAINER MEANS

[75] Inventor: Leonard Thomas LaCroce, Paramus, N.J.

[73] Assignee: American Can Company, Greenwich, Conn.

[22] Filed: June 21, 1976

[21] Appl. No.: 698,221

[52] U.S. Cl. ..... 220/269; 222/529; 222/541; 220/271

[51] Int. Cl.[2] ..... B65D 41/32

[58] Field of Search ..... 220/269–273; 222/541, 529

[56] References Cited

UNITED STATES PATENTS

| | | | |
|---|---|---|---|
| 3,404,801 | 10/1968 | Silver | 220/269 |
| 3,780,902 | 12/1973 | Holc et al. | 220/270 |
| 3,929,252 | 12/1975 | LaCroce | 220/269 |

*Primary Examiner*—George T. Hall
*Attorney, Agent, or Firm*—Robert P. Auber; Ira S. Dorman; George P. Ziehmer

[57] ABSTRACT

An end cover or closure for an accurate pour style container that is particularly well suited for use with non-viscous liquids has included thereon a displaceable portion proximate the periphery which prescribes an opening in the cover that is size-limited by means of a short score in the panel having reversely-curled ends, there being a non-detachable pull tab attached to said displaceable portion with a pull ring for the tab disposed radially inwardly from the point of tab attachment; the tab and the displaceable portion of the cover when opened being adapted to pivot through about 90° with the tab then assuming a thus stopped position generally perpendicular to the container end panel adjacently neighboring the side wall of the enclosed container so that the extended open tab can thereupon function as a very effective and efficient pour guide for effluent during container discharge. Safety features tending to resist hand opening by means of hold-down nibs of the so-called "child-resistant" type may advantageously be incorporated in the pull ring design.

28 Claims, 5 Drawing Figures

FIG. 1
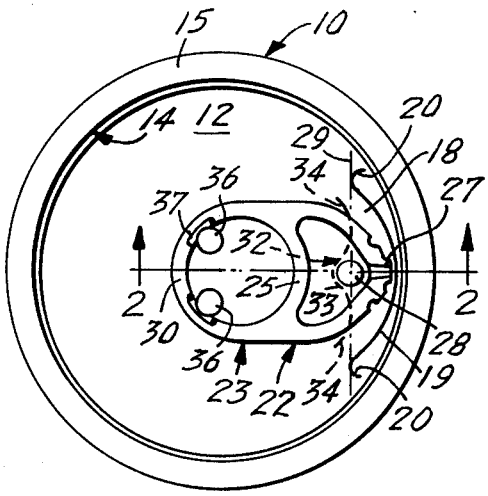
FIG. 5
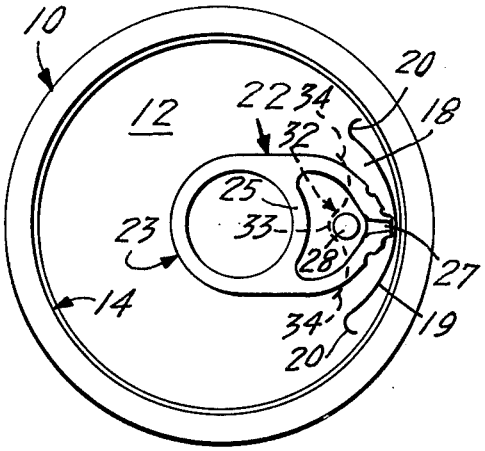
FIG. 2
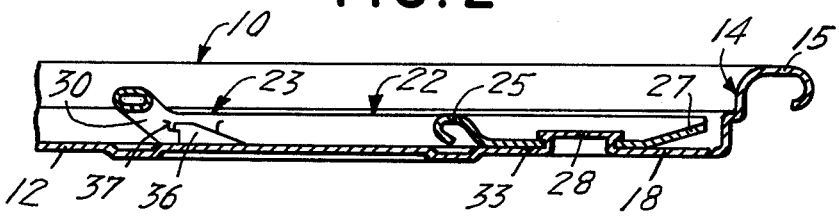
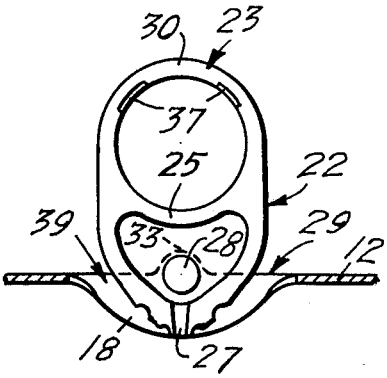
FIG. 4
FIG. 3
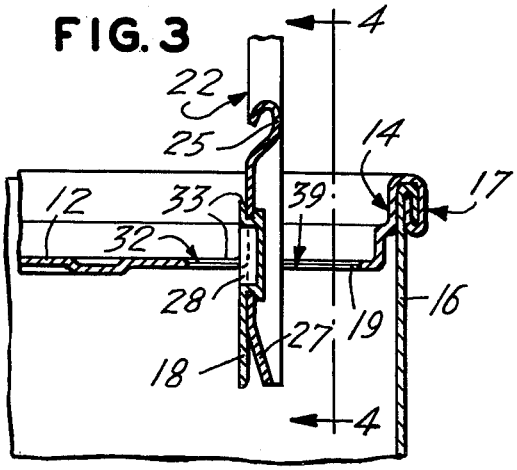

ACCURATE FLOW CONTROL CONTAINER MEANS

BACKGROUND OF THE INVENTION

Many non-viscous liquid products are desirably packaged in pull tab-type containers for easy opening and ready discharge of contents from the container. A good number of such products, however, are intended for discharge from the container into relatively small and confined receptacle inlets; this being particularly well illustrated in the instances where automotive and fuel or lubricant additive materials are packaged in containers intended to be discharged into the openings of gasoline tanks or other storage units. In such cases, the demands of ultimate convenience and efficiency militate against the use of funnels and the like flow-controlling or -directing auxiliaries.

The known easy opening, pull tab-style containers (or, more precisely, the end covers for same) are not well adapted upon being opened to have automatically and effectively thereupon an integral and efficient pour guide resulting from the pulled-up tab with which good and accurate flow control can be achieved for and upon the discharge during entire emptying of the container's contents.

This is despite the fact that most pull tabs for easy opening container ends are capable, regardless of their normal operating orientation, of being pivoted, rocked or otherwise positioned into an attitude more or less perpendicular to the end. This alone, however, is not adequate for the upraised tab to effectively function as a pour guide. For such desideratum, the pour orifice must be sufficiently restricted so that the fluid discharge, especially from a full container, can be controllably poured down the extended open tab which, at the same time, must be positioned sufficiently close to the container wall so that the tab continues its function as a pour guide until the container is effectively empty.

The indicated criteria are not met by containers wherein the operating attitude of the pull tab is in a non-interfering, folded back position. Neither is it fulfilled by containers wherein the upraised pull tab creates too large an opening tending to preclude exercise of effective control over fluid being poured from a full container and/or to lose any possibility or means of control with a partially (say, ¼ to ⅓) full container. The same applies to containers wherein the opened, upraised tab is positioned too closely to the center of the end panel or where precise partial opening to avoid such an inefficient end location of the upstanding tab would require, on each occasion of container opening, the not automatically and certainly predeterminable final efficient pour guide disposition of the tab but an unreliable and not inherently or easily determinably exercise of unpredicatable judgement and experimentation to possibly change the obtention of a good-enough pour guide manipulation for each single operating occassion.

Obviously, the drawbacks and inadequacies of known easy open containers for utilization in the mentioned capacity and for the indicated purpose lead overwhelmingly and literally invariably to disadvantageous, vexatious and usually unavoidably wasteful and undesirable consequences.

FIELD AND OBJECTIVES OF THE INVENTION

The present invention, and the principal aims and objectives attainable in its practice, pertain(s) and direct(s) to an end cover or closure (of the style frequently designated as a "partial-open" type) for a pour-style container as well as containers enclosed therewith adapted to very effectively and accurately control and direct flow of contents during discharge which end cover is characterized in having a peripherally disposed and situate displaceable portion of the cover panel which is rupturable without tearback to form an opening and is openable by means of a standup pull tab thereon that, in open position, functions as an integral baffle and pour guide for the issuing liquid contents of the container when the latter is appropriately turned or tiled for pouring into any desired channel, such as a gasoline tank fill tube or passageway in a motor vehicle or the like or other storage vessels, and so forth.

PARTICULARIZED DESCRIPTION OF THE INVENTION

Further features and characteristics of the accurate pour guiding container(s) and end cover(s) therefor and in accordance with the present invention are more evident in the explanation and description in the following part of the specification, taken in conjunction with the accompanying drawing, wherein:

FIG. 1 is a top plan view of a container end cover or closure pursuant to the instant invention;

FIG. 2 is an enlarged cross-sectional view of a portion of the cover taken along Line 2—2 in FIG. 1;

FIG. 3, on the same enlarged scale and also taken along Line 2—2 in FIG. 1, is a cross-sectional view of the cover in open position and, additionally, schematically showing it mounted as an end for a container body;

FIG. 4, on a somewhat reduced scale, is a front elevation view, partly in section, taken along Line 4—4 in FIG. 3 further illustrating the container end in open position; and FIG. 5, in the same scale as the showing of FIG. 1, is a top plan view of the basic cover of the invention devoid of hold-down nibs or the like opening-resistant, safety feature attachments.

For expedience and enhanced clarity of associated components and elements, simultaneous reference is now had to all the included FIGURES in the drawing with explanation thereof in the following catalogued description of parts which are identified by like reference numerals wheresoever they are depicted in the various involved views:

| Reference Numeral | Description With Relevant Collary Explanation |
|---|---|
| 10 | General designation of ordinarily circular end cover made of any desired and suitable rupturable material of construction such as steel, aluminum, tin plate or the like and their equivalents. |
| 12 | Generally planar central panel portion of end cover which, optionally (although not shown in particular detail) may be ribbed or otherwise indented or configured for reinforcement and/or legend-bearing or other decorative purposes. |
| 14 | Countersink wall integral with panel 12 and into which latter merges. |

-continued

| Reference Numeral | Description With Relevant Collary Explanation |
|---|---|
| 15 | Integral outwardly extending curled flange merged with countersink wall 14 (and which, as is particularly illustrated in FIG. 4, is adapted for interfolding with the end flange of a container body to form the end seam of the structure). |
| 16 | Broken out segment of container body wall. |
| 17 | End seam in covered container. |
| 18 | Displaceable portion of end panel through area of which container opening is formed. |
| 19 | Peripheral score line which defines and includes displaceable portion 18 and allows displacement thereof on opening rupture. |
| 20 | Reversely curled or arced terminal portions or increments of peripheral score line 19 which delimit and define length of same and inhibit panel tearing therebeyond when displaceable portion 18 is displaced or bent and disposed inwardly on opening so as to thereby delineate the partial-open portion of the central panel 12 which remains attached on opening to the end cover. |
| 22 | Opening device or pull tab (which obviously lies within the confines of central panel 12). |
| 23 | Radially inwardly extending handle portion or pull ring of opening tab which, alternatively, may have any desired shape other than annular such as rectangular, triangular and so forth or may in certain instances be especially structured to enhance better outflow. |
| 25 | Web portion of opening tab 22 to which handle portion 23 is attached and in which stress concentrating nose portion is formed in opposite, peripherally extending disposition from the handle portion 23, which may be a pull ring, and which is also adapted to accept and engage a tab rivet or equivalent fastening means for attachment of opening tab 22 to displaceable portion 18. |
| 27 | Stress concentrating nose portion of opening tab 22 which generally terminates at or slightly short of the inward side of the peripheral score line and which, on the opening, inwardly-pulled actuation of the tab, ruptures peripheral score line 19 to achieve outlet-forming inward displacement of displaceable portion 18. |
| 28 | Attachment rivet for tab 22 to displaceable portion 18. |
| 29 | Bendable side or depression turn line about which displaceable portion 19 pivots when opened (as depicted by the dashed line in FIG. 1 and the bent edge of displaceable portion 19 in opened position in FIG. 4). |
| 30 | Angularly raised radially inward end of pull ring provided to allow insertion of a small prying tool (not shown) such as a coin or the blade of a knife, screw driver, etc., to facilitate opening. |
| 32 | Optional, albeit advantageously utilized, "moustache" vent or ancillary score impressions towards the outer edge section of displaceable portion 18 having a curved central segment passing immediately behind the rivet 28 and extending outwardly from said curved central segment to merge inwardly to curled terminal segments to function in rupture assistance of peripheral score line 19 by the known mechanism as is described, for example, in U.S. Pat. No. 3,606,076. |
| 33 | Curved central segment of vent score 32. |
| 34 | Curled terminal segments of vent score 32. |

-continued

| Reference Numeral | Description With Relevant Collary Explanation |
|---|---|
| 36 | Optional (and not necessary to successful practice of the invention) bosses, nibs or hold-down posts with extending, catch-like upper portions thereon formed in central panel 12 by dimpling or thereon provided as otherwise desired to achieve an opening-resisting, safety feature added to the container pursuant to the teachings of U.S. Pat. No. 3,929,252, which nibs are best positioned to lie within pull ring 23 adjacent either side of the inner edge of raised end 30 to engage and interlock with mating indentaions or clasp or striker areas on the pull ring. |
| 37 | Nib-receiving indentations on pull ring. |
| 39 | Opening. |

Advantageously in practice of the present invention:

A. The peripheral score line 19 is as close as possible to the flat edge of central panel 12, preferably being situate at closest proximity at a distance of between about 50 and 100 mils from the edge.

B. The radially inward, bendable side or depression turn line 29 of the displaceable portion 18 should be situate on the central panel at a distance from the edge that is approximately between about 1/6 and ⅓ of the radius or other maximum flat dimension of the panel with this distance frequently being more desirable when it is about ¼ of the radius especially in the more popular sized containers that are commonly utilized.

C. The arcuate, circumferential measure of the peripheral score line 19 should be between about 60° and 150°, preferably between about 100° and 120°.

D. The reversely curled terminating ends of the peripheral score line 19 should lie somewhere relatively near, if not truly on, the approximate chord line that would be defined as passing through the bendable edge of the displaceable portion 18 (especially in cases where cylindrical containers are involved).

E. The size of the pour opening formed upon inward bending displacement of displaceable portion 18, especially in the popular sized containers that roughly have 2.6 inch diameters, should be between about 4 and about 8%, preferably approximately 6%, of the flat area of central panel 12 and in most cases should also be at least ¼ square inch and not more than ⅔ or so of a square inch.

F. The length of the tab 22 should at least approximate, if not somewhat exceed, the radius of the end panel 12.

In operation, the tab and displaceable portion of the end are pivoted through 90° to form and provide an opening in the end cover of the container. In this position, the tab is at least substantially, if not perfectly, perpendicular to the plane of the end panel and quite close to the side wall of the container. In this, the tab tends to stop automatically in the vertically upraised situation at the end of the opening action due to the natural course of the tab pulling manipulation coupled with increasing resistance to further bending in the depressable portion as the tab approaches a vertical disposition. In this way, the vertically upraised tab can function as an accurate and very influential pour guide to most advantageously direct the flow of the fluid contents from the container. The use of a reverse curl in the peripheral score line in place of the conventional tear back score provides the desired definite restriction in the size of the opening in the end panel and thereby contributes importantly to and facilitates flow control of the non-viscous products with which practice of the present invention are most beneficially accomplished. The stand-up tab further serves as a deterrent to drinking directly from the container. And, as has been indicated, the tab may be utilized if so desired with adaptations therewith of the above-described and herein illustrated (child) safety hold-down nibs.

The excellent results achieved in practice of the present invention are obtained by the very propitious and functionally adapted inter-relationship and correlation of the stand-up tab positioned and effectively spaced at the inner edge of the peripherally situate opening which is appropriately and adroitly sized to allow the outflowing contents, upon pouring, to be controlled and directly in their passage by the baffle and guide influence of the vertically upstanding tab means.

Many changes and modifications can readily be made and adapted in embodiments in accordance with the present invention without substantially departing from its apparent and intended spirit and scope, all in pursuance of and accordance with same as it is set forth and defined in the hereto appended claims.

What is claimed is:

1. An accurate pour-guiding and flow-controlling end closure of the partial-open, pull-tab type well suited for directional discharge handling of relatively non-viscous fluids, said closure comprising:

a generally flat central panel portion;

means associated with said central panel portion for securing said closure as an end cover for a container to be sealed therewith;

a rupturable peripheral score line in said central panel which defines and circumvents a displaceable portion of said central panel which displaceable portion is bendable inwardly upon rupture of said peripheral score line to form an opening in said central panel;

said rupturable peripheral score line having curled terminal increments which delimit the length of the score line and inhibit panel tearing therebeyond when said displaceable portion is inwardly bent and disposed upon rupture to form said opening of said score line; and an opening tab attached to said displaceable portion of said panel at a point at least substantially proximate a line extending at least generally between the areas of said curled terminal increments of said peripheral score line on said panel;

said opening tab having a nose portion at one of its ends and a handle portion at its other end permitting situation of the nose portion so as to be disposed proximate the rupturable peripheral score line in said central panel;

said pull ring of the opening tab being disposed radially inwardly from its point of attachment on said cover and extending substantially beyond said point;

said opening tab adapted upon application of upraising leverage thereto to rupture said peripheral score line and inwardly bend said displaceable portion to form an opening in said panel with said tab then extending vertically upwardly from said panel to stop in at least a substantially perpendicular disposition with respect to the plane of said central panel in which situation said tab is capable of a baffle and pour-guide function for fluid material issuing from and through said opening.

2. The end closure of claim 1 and including, in addition thereto and in combination therewith, an ancillary vent score towards the outer edge section of the displaceable portion and passing in fanciful moustache configuration having radially inwardly curled end segments and a central radially inward bulge segment accommodating and immediately behind the point of attachment of said opening on said displaceable portion of said panel.

3. The end closure of claim 2 and further including, in addition thereto and in combination therewith, means on said central panel for releasably engaging the pull ring of said opening tab to maintain and resist movement of the pull ring in its position when said opening tab remains in unopened disposition.

4. The end closure of claim 1 and including, in addition thereto and in combination therewith, means on said central panel for releasably engaging the pull ring of said opening tab to maintain and resist movement of the pull ring in its position when said opening tab remains in unopened disposition.

5. A metallic end closure according to claim 1.

6. The end closure of claim 1, wherein said peripheral score line is situate at closest proximity to the flat edge of said central panel at a distance of between about 50 and about 100 mils from said edge.

7. The end closure of claim 1, wherein the radially inward depression turn line of said displaceable portion of the central panel lies at a distance from the edge of said panel that is between about 1/6 and about ⅓ of the maximum flatly extending dimension of said panel.

8. The end closure of claim 1, wherein the radially inward depression turn line of said displaceable portion of the central panel lies at a distance from the edge of said panel that is about ¼ of the maximum flatly extending dimension of said panel.

9. The end closure of claim 1, wherein the area of the opening formed by displacement of the displaceable portion of said central panel is between about 4 and about 8% of the flat area of said panel.

10. The end closure of claim 1, wherein the area of the opening formed by displacement of the displaceable portion of said central panel is about 6% of the flat area of said panel.

11. The end closure of claim 1, wherein said closure is circular; and the arcuate circumferential measure of said peripheral score line is between about 60° and about 150°.

12. The end closure of claim 1, wherein said closure is circular; and the arcuate circumferential measure of said peripheral score line is between about 100° and about 120°.

13. The end closure of claim 1, wherein the radially inwardly extending length of said opening tab lies within the confines of the central panel of the closure and approximates the maximum flatly extending dimension of said central panel.

14. The end closure of claim 1, wherein said closure is circular; and the radially inwardly extending length of said opening tab lies within the confines of the central panel of the closure and is at least as great as the radius of said central panel.

15. An opened end closure according to claim 1 with said opening tab stopped in a vertically upward disposition with respect to the generally flat plane of the central panel of said closure in at least a substantially perpendicular inter-relationship.

16. An opened end closure according to claim 2 with said opening tab stopped in a vertically upward disposition with respect to the generally flat plane of the central panel of said closure in at least a substantially perpendicular inter-relationship.

17. An opened end closure according to claim 3 with said opening tab stopped in a vertically upward disposition with respect to the generally flat plane of the central panel of said closure in at least a substantially perpendicular inter-relationship.

18. An opened end closure according to claim 4 with said opening tab stopped in a vertically upward disposition with respect to the generally flat plane of the central panel of said closure in at least a substantially perpendicular inter-relationship.

19. A container covered at its upper end by an end closure in accordance with the end closure of claim 1.

20. A container covered at its uper end by an end closure in accordance with the end closure of claim 2.

21. A container covered at its upper end by an end closure in accordance with the end closure of claim 3.

22. A container covered at its upper end by an end closure in accordance with the end closure of claim 4.

23. A container covered at its upper end by an end closure in accordance with the end closure of claim 6.

24. A container covered at its upper end by an end closure in accordance with the end closure of claim 7.

25. A container covered at its upper end by an end closure in accordance with the end closure of claim 9.

26. A container covered at its upper end by an end closure in accordance with the end closure of claim 11.

27. A container covered at its upper end by an end closure in accordance with the end closure of claim 13.

28. A container covered at its upper end by an end closure in accordance with the end closure of claim 14.

* * * * *